United States Patent [19]

Faulks

[11] Patent Number: 5,019,291

[45] Date of Patent: May 28, 1991

[54] COMPOSITION FOR REMOVING ASBESTOS

[75] Inventor: James N. G. Faulks, Hampshire, England

[73] Assignee: BP Chemicals Limited, London, England

[21] Appl. No.: 304,951

[22] Filed: Feb. 1, 1989

[30] Foreign Application Priority Data

Feb. 9, 1988 [GB] United Kingdom ..... 8802959

[51] Int. Cl.[5] ..... B08B 7/00; C11D 1/72; C11D 1/722; C11D 3/37

[52] U.S. Cl. ..... 252/174.22; 134/4; 252/162; 252/170; 252/173; 252/174.21; 427/154

[58] Field of Search ..... 252/174.21, 174.22; 134/4, 6; 427/154

[56] References Cited

U.S. PATENT DOCUMENTS

| | | | |
|---|---|---|---|
| 4,274,884 | 6/1981 | Cartwright | 134/4 |
| 4,347,150 | 8/1982 | Arpin | 252/135 |
| 4,537,802 | 8/1985 | Flanagan | 427/368 |
| 4,632,847 | 12/1986 | Lomansey et al. | 427/154 |
| 4,693,755 | 9/1987 | Erzinger | 134/4 |
| 4,699,666 | 10/1987 | Tidquist et al. | 134/4 |
| 4,772,413 | 9/1988 | Massaux et al. | 252/102 |

FOREIGN PATENT DOCUMENTS

| | | | |
|---|---|---|---|
| 6150474 | 4/1980 | Japan | 134/4 |

*Primary Examiner*—A. Lionel Clingman
*Assistant Examiner*—A. Beadles-Hay
*Attorney, Agent, or Firm*—Brooks Haidt Haffner & Delahunty

[57] ABSTRACT

A composition which can be applied to old asbestos before it is removed from old plant, apparatus of buildings is provided. The composition, which is in the form of a concentrate to be diluted with water, consists of:

(a) from 1 to 20% by weight of a $C_{12}$ to $C_{20}$ secondary alcohol alkoxylate having a molecular weight in the range 500 to 700.

(b) from 0.1 to 20% by weight of a polyoxyethylene-oxypropylene block copolymer having an average molecular weight in the range 1800 to 2000 and an ethylene oxide content of between 8 and 12% by weight.

(c) from 10 to 60% by weight of a random polyoxyethylene oxypropylene glycol ether having an average molecular weight in the range 1500 to 3500 and an ethylene oxide content of between 40 and 75% by weight.

(d) the balance, if required, being water.

5 Claims, No Drawings

COMPOSITION FOR REMOVING ASBESTOS

The present invention relates to a composition for removing asbestos and a process for removing asbestos employing such a composition.

Historically, the asbestos minerals, of which Crocidolite, Chrysolite and Amosite are the most common, have been widely applied as insulation for boilers, pipework etc., fire breaks, and in the construction industry.

The health hazards associated with asbestos are now well established and it is known that exposure to asbestos fibres, under conditions where they can enter the respiratory system, can lead to a number of lung diseases including lung cancer, asbestosis and mesotheliana of the pleura or peritoneum. As a consequence of these health hazards, many countries now make it necessary to observe strict precautions when handling or manufacturing asbestos based materials. For example, in the United Kingdom statutory control in the form of Asbestos Regulations 1969 and the Health and Safety at Work Act 1974 is now in force.

A particular problem in handling asbestos arises when it is necessary to strip old asbestos insulation from existing plant, apparatus or buildings. In such situations, the removal of the asbestos almost inevitably leads to the release of large quantities of asbestos fibres into the air.

It has previously been the practice to soak old asbestos insulation with water before it is removed. Whilst this prevents some of the fibres being released into the air it is desirable, if possible, to reduce such levels further.

A composition for use in the stripping of asbestos and a process for stripping asbestos are now provided which considerably reduce the quantities of asbestos dust released into the air during stripping.

According to the present invention there is provided an asbestos-stripping concentrate composition which consists essentially of:

(a) from 1 to 20% by weight of a $C_{12}$ to $C_{20}$ secondary alcohol alkoxylate having a molecular weight in the range 500 to 700.

(b) from 0.1 to 20% by weight of a polyoxyethylene-oxypropylene block copolymer having an average molecular weight in the range 1800 to 2000 and an ethylene oxide content of between 8 and 12% by weight.

(c) from 10 to 60% by weight of a random polyoxyethylene oxypropylene glycol ether having an average molecular weight in the range 1500 to 3500 and an ethylene oxide content of between 40 and 75% by weight.

(d) the balance if required being water.

The asbestos-stripping composition described above is a concentrate and is suitably diluted with between 2 and 5 volumes of water, per volume of concentrate to produce a solution suitable for use as a stripper.

As regards component (a) of the composition, this is suitably a $C_2$ to $C_4$ alkoxylate preferably an ethoxylate of a $C_{12}$–$C_{14}$ secondary alcohol. The molecular weight of component (a) is suitable in the range 560 to 640.

Component (b) is preferably the material sold under the trade name Breox 19-10. Breox is a registered trademark of BP Chemicals Ltd.

As regards component (c), this is suitably a $C_1$ to $C_4$ alkyl ether, preferably a butyl ether of the random polyoxyethylene oxypropylene glycol.

The composition preferably also contains a dye, e.g. Rhodamine Base B, as this makes it easier to determine visually the extent of asbestos wetting after application.

According to a further embodiment of the present invention, there is provided a process for stripping asbestos from a substrate which comprises spraying the diluted asbestos-stripping concentrate composition onto the asbestos, allowing the asbestos to absorb the diluted asbestos-stripping concentrate composition, repeating if necessary the spraying until the asbestos is fully wetted and softened and thereafter stripping the fully wetted and softened asbestos from the substrate.

It is preferable to spray the diluted asbestos-stripping concentrate onto the substrate initially at low pressure so that major disturbance of the outer fibres is avoided. Further sprayings can be carried out at a higher pressure. It is particularly preferred to carry out a plurality of sprayings separated by intervals (e.g. 1–3 minutes) during which the diluted asbestos-stripping concentrate is allowed to penetrate the asbestos. Sprayings are continued until the asbestos is fully wetted and softened as determined by e.g. core sampling and analysis.

The degree of application of the diluted asbestos-stripping concentrate will depend upon the thickness of the asbestos. It has been found that for asbestos having a thickness of less than 12 mm an acceptable minimum application is between 2 and 4 liters per square meter.

Suitable sprayers which have been shown through trials to be effective are the "Killaspray" (trademark) unit manufactured by Hazelock-ASL or the "Falcon" (trademark) unit manufactured by Cooper Reglar.

The asbestos may be wetted and softened by an injection process as an alternative to spraying. Accordingly, therefore, in a further embodiment of the invention there is provided a process for stripping asbestos from a substrate which comprises injecting the diluted asbestos-stripping concentrate into the asbestos, through a lance pushed into the asbestos, until the asbestos is fully wetted and softened and thereafter stripping the fully wetted and softened asbestos from the substrate.

Using an injection process it is preferable to make injections into the asbestos 50 to 75 mm apart. As a guide to the level of application it has been found that for 25 mm thickness asbestos covering 50 mm ID pipe, a dosage of 1.5–2.5 liters per meter is acceptable.

Relative to water alone the compositions of the present and diluted versions thereof on the other hand produce a tacky residue as opposed to a slurry. After stripping the asbestos can be placed in bags for disposal.

The invention is now illustrated by the following Examples.

EXAMPLE 1

Preparation of the Concentrate

The following components were blended together until a homogeneous composition was formed.

Breox 50A380: 500 g
Surfactant T9: 100 g
Breox BL 19-10: 1 g
Water (deionised): 398 g
Rhodamine Base B: 1 g Breox 50A380 (ex BP Chemicals) is a random polyoxyethylene-oxypropylene glycol monobutyl ether having an average molecular weight in the range 1700 to 3400 and an ethylene oxide content of 40 to 75% by weight.

Surfactant T9 (ex BP Chemicals) is a $C_{12}/C_{14}$ secondary alcohol ethoxylate having an average molecular weight in the range 560 to 640.

Breox 19-10 (ex BP Chemicals) is a block polyoxyethylene-oxypropylene block copolymer with an average molecular weight in the range 1800 to 2000 and an ethylene oxide content in the range 8 to 12% by weight.

EXAMPLE 2

A 20% by volume solution of the concentrate of Example 1 in water was prepared.

Asbestos Fibre Release Tests

Four samples of a thin woven band of chrysolite were taken.

Sample 1 was soaked for 60 minutes in the concentrate of Example 1.

Sample 2 was soaked for 60 minutes in the solution of Example 2.

Sample 3 was soaked for 60 minutes in water.

Sample 4 was untreated.

Fibre release tests were performed in a sealed enclosure having an entrance consisting of a three stage air lock. Each sample was taken into the chamber by an operator wearing appropriate safety apparatus. The sample was flexed 10 times by the operator. The amount of asbestos fibre released into the air was measured by a personal sampler worn by the operator and a stationary sample located in the middle of the enclosure. Between testing each sample the enclosure was thoroughly cleaned.

EXAMPLE 3

Sample 1 was tested by the above procedure. The results were:

Stationary sampler: 0.02 fibres/ml of air

Personal sampler: 0.02 fibres/ml.

EXAMPLE 4

Sample 2 was tested by the above procedure. The results were:

Stationary sampler: <0.01 fibres/ml

Personal sampler: <0.01 fibres/ml.

EXAMPLE 5

Sample 3 was tested by the above procedure. The results were:

Stationary sampler: 0.03 fibres/ml

Personal sampler: 0.03 fibres/ml.

EXAMPLE 6

Sample 4 was tested by the above procedure. The results were:

Stationary sampler: 0.04 fibres/ml

Personal sampler: 0.04 fibres/ml.

The above results show that, whilst the concentrate and the diluted version can both be used as stripping agents, especial improvements are achieved in the case of the latter. In particular when the solution according to Example 4 is employed a substantial and unexpected drop in the quantity of asbestos fibres released is obtained.

I claim:

1. An asbestos stripping concentrate composition which consists of:

(a) from 1 to 20% by weight of a $C_{12}$ to $C_{20}$ secondary alcohol alkoxylate having a molecular weight in the range 500 to 700.

(b) from 0.1 to 20% by weight of a polyoxyethylene-oxypropylene block copolymer having an average molecular weight in the range 1800 to 2000 and an ethylene oxide content of between 8 and 12% by weight.

(c) from 10 to 60% by weight of a random polyoxyethylene oxypropylene glycol ether having an average molecular weight in the range 1500 to 3500 and an ethylene oxide content of between 40 and 75% by weight.

(d) optionally a dye in an amount effective to visually determine the extent of asbestos wetting after application.

(e) the balance if required being water.

2. An asbestos stripping concentrate composition as claimed in claim 1 wherein component (a) is an ethoxylate of a $C_{12}$ to $C_{14}$ secondary alcohol having a molecular weight in the range 560–640.

3. An asbestos stripping concentrate composition as claimed in claim 1 wherein component (c) is a $C_1$ to $C_4$ alkyl ether.

4. An asbestos stripping concentrate composition as claimed in claim 3 wherein component (c) is a butyl ether.

5. An asbestos stripping composition which comprises the asbestos stripping concentrate composition as claimed in claim 1 diluted with between 2 and 5 volumes of water.

* * * * *